United States Patent [19]

Williamitis

[11] 4,075,866

[45] Feb. 28, 1978

[54] REFRIGERATOR DEFROSTER-HUMIDIFIER

[75] Inventor: Victor A. Williamitis, Kettering, Ohio

[73] Assignee: General Motors Corporation, Detroit, Mich.

[21] Appl. No.: 757,679

[22] Filed: Jan. 7, 1977

[51] Int. Cl.[2] ..... F25D 23/06; F25D 11/02; B01D 47/16; F02M 17/28

[52] U.S. Cl. ..... 62/274; 62/441; 261/99

[58] Field of Search ..... 62/187, 274, 408, 419, 62/441; 98/31; 165/105; 261/97, 99

[56] References Cited

U.S. PATENT DOCUMENTS

| | | | |
|---|---|---|---|
| 2,323,511 | 7/1943 | Baker | 62/274 |
| 3,278,175 | 10/1966 | Hirtz | 261/99 |
| 3,299,795 | 1/1967 | Teixeira | 98/31 |
| 3,394,557 | 7/1968 | Kronenberger et al. | 62/441 |
| 3,403,534 | 10/1968 | Bright et al. | 62/441 |
| 3,497,188 | 2/1970 | McDuffee | 261/99 |
| 3,592,451 | 7/1971 | McDuffee | 261/103 |
| 3,599,442 | 8/1971 | Hanson | 62/441 |
| 3,609,988 | 10/1971 | Bright | 62/187 |
| 3,786,861 | 1/1974 | Eggers | 165/105 |

*Primary Examiner*—Lloyd L. King
*Attorney, Agent, or Firm*—Edward P. Barthel

[57] ABSTRACT

A counter current defroster-humidifier arrangement, having a plurality of layered sets of parallel air flow passages formed by corrugated paper-like or porous material, is located in the above-freezing compartment of a refrigerator. The device receives moisture-laden air from the above-freezing compartment for flow in one direction through first alternate sets of parallel layered sets of air passages. The moisture is both absorbed and adsorbed within the passages and transpires or diffuses through the passage walls into the second alternate layered sets of passages which receive cooled dry air exiting the evaporator chamber for flow in the opposite direction. Thus, the arrangement substantially reduces the moisture content of the food compartment air prior to its return to the evaporator chamber while maintaining the food compartment in a high humidity food preserving condition by returning the transpired absorbed and adsorbed moisture to the chilled return air.

3 Claims, 5 Drawing Figures

REFRIGERATOR DEFROSTER-HUMIDIFIER

This invention relates to dual compartment domestic refrigerators having freezer and above-freezing food storage compartments and more particularly to such arrangements having a defroster-humidifier arrangement in the above-freezing compartment which functions both to remove moisture from the above-freezing air entering the evaporator plenum and to return this moisture to the below-freezing air prior to its return to the food storage compartment.

Domestic, dual zone, frost-free refrigerators commonly utilize a forced air common refrigerant system having evaporator means located in a plenum through which air is circulated for cooling the separated compartments. In such refrigerators there is a tendency to freeze out air moisture content on the evaporator. The result is an expenditure of additional energy to freeze out this moisture and also to periodically defrost the moisture from the evaporator. In addition the humidified dry air returned to the food storage compartment causes undesirable dehydration of food stored therein.

It is an object of the present invention to minimize the undesirable drying out of food stored in a domestic refrigerator by the use of a countercurrent humidifier moisture exchanger having sets of parallel passages in alternate layers operative to remove moisture from the air flowing to the refrigerator evaporator plenum wherein the driving force for the transpiration of the moisture through the passage walls, formed from hydrophilic fibers or porous material, is the moisture-vapor pressure differential between the warmer humid air entering the exchanger from the food storage compartment and the colder near-zero moisture vapor pressure air entering the moisture exchanger from the freezer compartment, thereby reducing the moisture in the evaporator plenum and to return it to the food storage compartment, creating and maintaining a high humidity therein to prevent dehydration of food, thus extending the food preservation capacity of the refrigerator.

It is another object of the present invention to provide an improved dual compartment refrigerator-freezer by the provision therein of an air humidifier-defroster apparatus having a plurality of sets of parallel air passages providing a countercurrent flow of the air exiting the above-freezing compartment and the chilled air exiting from the evaporator plenum wherein the device is constructed from hydrophilic cellulosic paper material having absorptivity and porosity enabling a capillary and diffusion transfer of adsorbed and absorbed moisture across the flow passage partitions of membrane-like fashion wherein the moisture transpires, diffuses and capillaries across the passage walls and re-evaporates into the colder dry air returning from the evaporator plenum to prevent forced dry air dehydration of food stored within the refrigerator food compartments.

It is another object of the present invention to provide an improved domestic refrigerator having partition means separating the cabinet of the refrigerator into above-freezing and a below-freezing food storage compartment having an evaporator located in an evaporator plenum within the freezer compartment and fan means by which the air is circulated for cooling the compartments, and wherein a defroster-humidifier air exchanger in the above-freezing compartment includes a plurality of layered sets of first and second parallel air passages formed by corrugated porous paper-like material comprising alternating flat sheets and intermediate undulating sheets, whereby the circulation of relatively dry chilled air in the first set of passages and the circulation of moist above-freezing air in the second set of passages being in opposite directions such that an exchange of moisture through the porous flat sheets by the effect of transpiration from the second set of air passages to the first set of air passages results because of the moisture vapor pressure difference of the opposite flowing air streams; and whereby above-freezing relatively dry air exiting from the second set of passages is circulated over the evaporator for chilling thereof with a minimum of frost build-up, and whereby the chilled relatively moist air exiting from the first sets of air passages is circulated by the refrigerator air flow system to the above-freezing food compartment.

Further objects and advantages of the present invention will be apparent from the following description, reference being had to the accompanying drawings wherein a preferred embodiment of the present invention is clearly shown.

Figure 1:
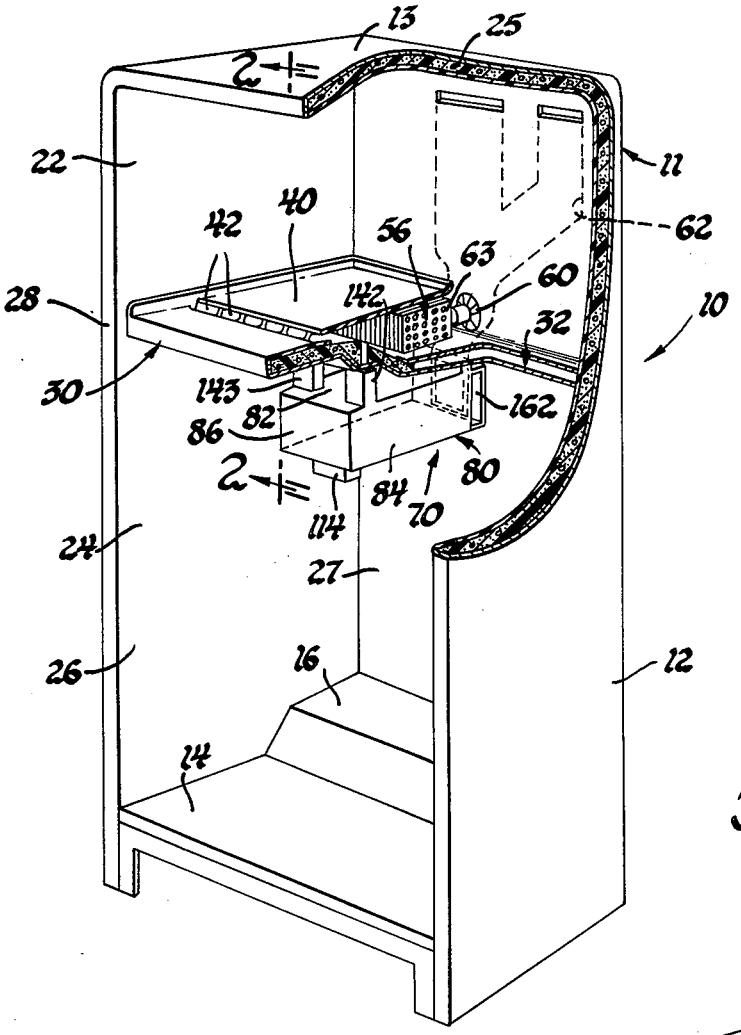
FIG. 1 is a perspective view of a refrigerator cabinet showing the location of the defroster-humidifier of the present invention.
Figure 2:
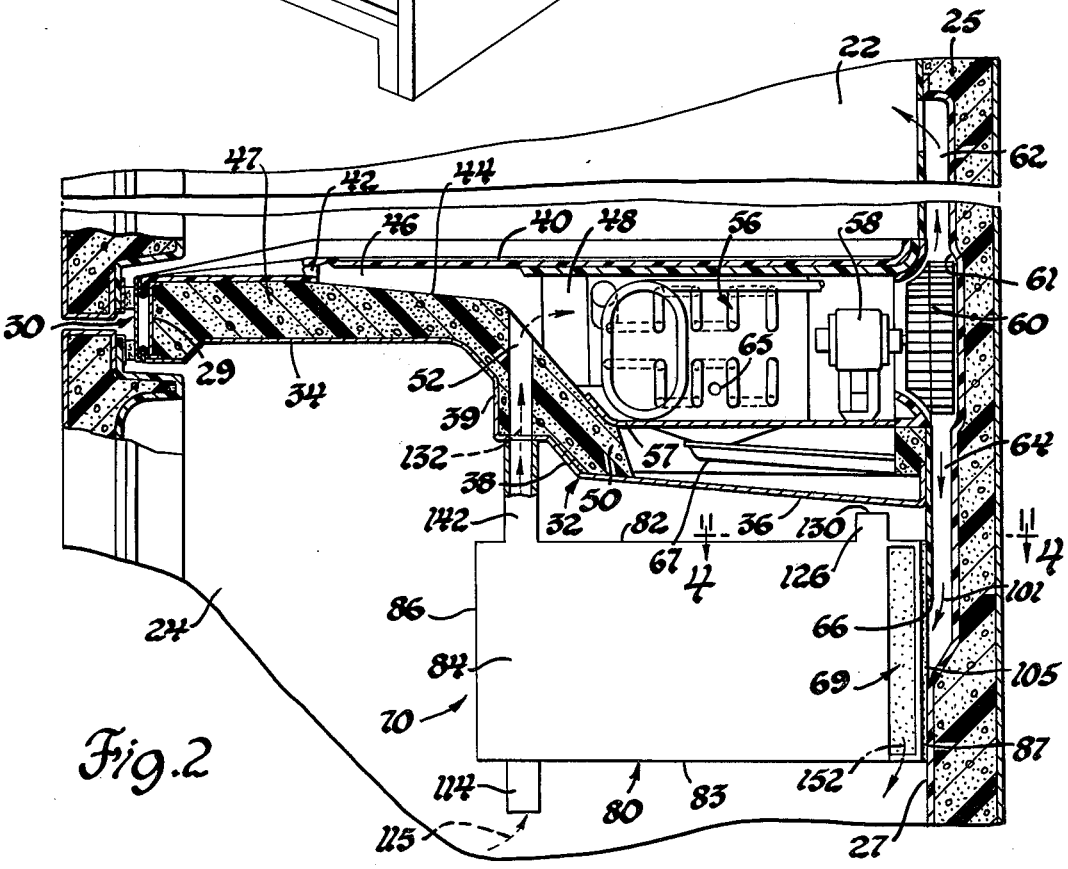
FIG. 2 is a fragmentary side elevational view taken substantially along line 2—2 of FIG. 1.

Referring now to the drawings and more particularly to FIGS. 1 and 2, there is shown an insulated household refrigerator cabinet 10 having an outer metal shell 11 with the visible portions including right side wall 12, top wall 13, bottom wall 14 including an upper offset portion 16 which forms the upper wall of the machinery compartment therebelow.

The refrigerator cabinet is provided with an upper freezer compartment 22, and a lower above-freezing cooling or fresh-food storage compartments 24, both being enclosed within an inner liner preferably formed of sheet plastic material, such as ABS copolymer plastic with the liner side wall 26 and rear wall 27 being visible in FIG. 1. The space between the inner walls, formed by the inner liner and the outer metal shell 11, is filled with suitable insulation material such as expanded polyurethane foam 25 which is conventional practice.

The shell side walls and the top wall are reinforced at the front with an inwardly turned flange 28 extending inwardly at substantially right angles to the side and top walls around the access opening of the cabinet. The cabinet is closed by a suitable insulated door which is shown removed in FIG. 1 for the purposes of clarity. Suitable brackets (not shown) extend through openings in flange 28 and support a front metal cross member 29 (FIG. 2) extending therebetween. Details of one such refrigerator cabinet construction are shown and described in U.S. Pat. No. 3,633,374 to James A. Canter and assigned to the same assignee as the present application.

As best seen in FIGS. 1 and 2, the upper and lower compartments are separated by an insulated horizontal partition assembly, generally indicated at 30, which includes a lower sheet metal wall 32 having a high front portion 34 and a low rear portion 36 with an inclined portion 38 and a stepped portion 39 formed therebetween. A top plastic member 40 of the partition assembly 30 partially defines with a series of air return openings or entrances 42 which connect with air passages 44 formed between supports 46 integrally molded in front insulation piece 47, which passages communicate with an evaporator chamber or plenum 48. Reference may be had to U.S. Pat. No. 3,599,442 to R. S. Hanson, assigned to the same assignee as the present application, for details of the passages 44. The evaporator chamber 48 is surrounded by insulation in the form of a member 50 having a passage 52 formed therein providing communication from the defroster-humidifier of the present invention, to be described, to the evaporator chamber 48.

The evaporator chamber 48 includes an evaporator 56 which is supported on a metal drain pan 57. The evaporator 56 is supplied with liquid refrigerant in a conventional manner as shown and described in the above-mentioned Hanson patent. An electric fan motor 58 is supported in the cabinet and includes a centrifugal impeller 60 located in a recessed portion 61 in the liner rear wall 27. The fan impeller 60 draws air from the freezer compartment 22 through the air inlet 42 into the evaporator chamber 48 and past the fins 63 of the evaporator 56 in heat exchange relation therewith. It will be noted that a defrost heater, partially indicated at 65 in FIG. 2, is received in a cutout portion of evaporator fins 63 (FIG. 1). In the disclosed form the defroster heater is a transversely extending radiant heater having a central location whereby it radiates heat downwartly to melt any ince in drain pan 57. A trough 67 directs water ice the rear wall of the cabinet as disclosed and explained in U.S. Pat. No. 3,599,422 to Hanson, assigned to the assignee of the present application. A portion of the chilled air exiting the evaporator chamber is discharged upwardly through a cabinet duct 62 into the freezer compartment 22 while a substantially reduced volume of chilled air is discharged downwardly through cabinet duct 64 for flow through duct exit 66 and into first rear header means of a defroster-humidifier arrangement generally indicated at 70, suitably supported beneath the partition assembly 30 in the above-freezing compartment 24 of the refrigerator. The first rear header means includes a central header duct 69 which receives the chilled or below-freezing air from the cabinet duct 64.

Figure 3:
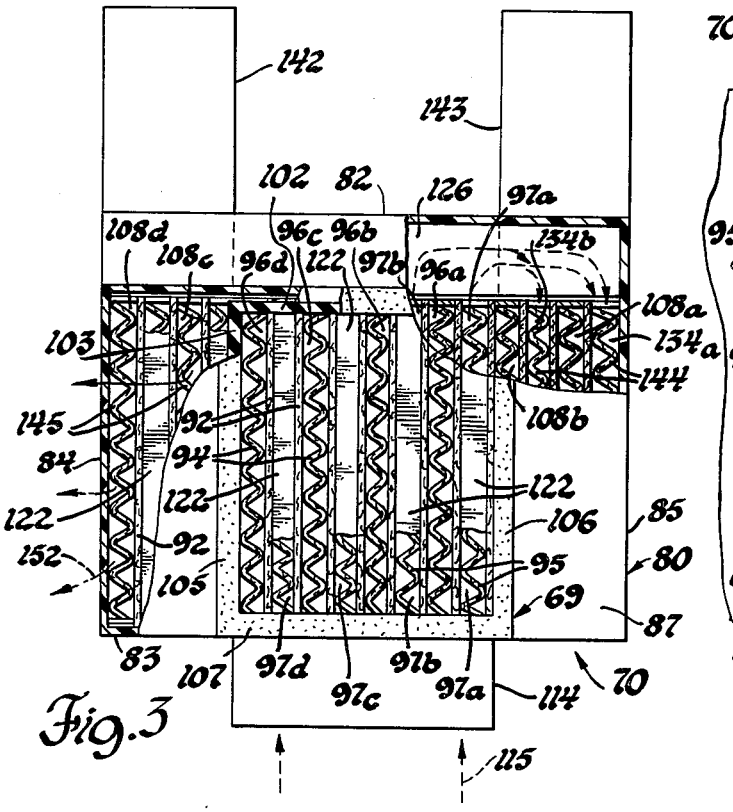
FIG. 3 is a detailed and elevational view, partly in section, of the defroster-humidifier apparatus of FIG. 2.
Figure 4:
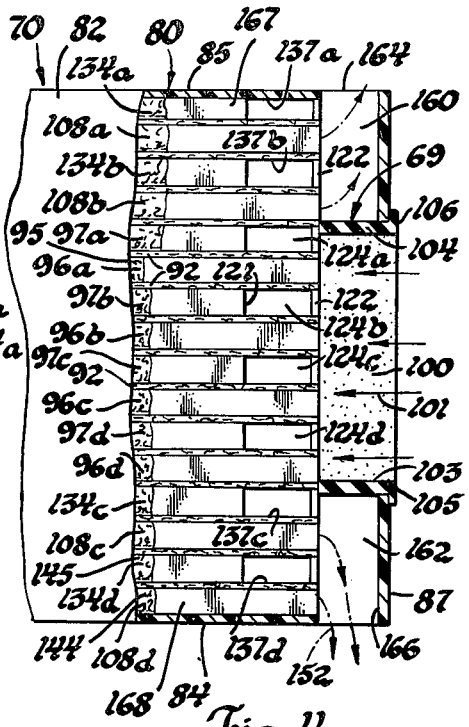
FIG. 4 is a fragmentary sectional view taken on line 4—4 of FIG. 2.
Figure 5:
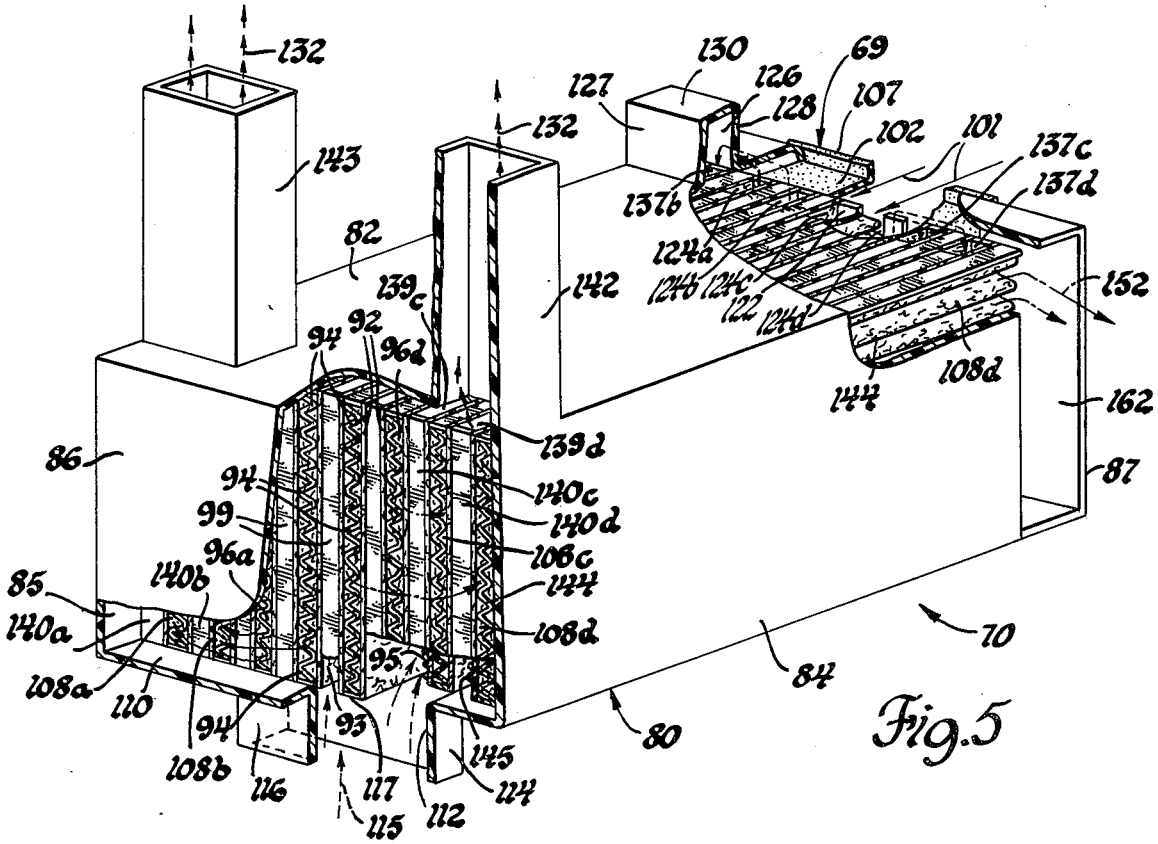
FIG. 5 is a perspective view of the defroster-humidifier of FIG. 3 with parts broken away to show the air flow passages.

As best seen in FIGS. 3–5, the humidifier-defroster apparatus is enclosed by an outer generally box-shaped rectangular housing 80 including upper 82 and lower 83 walls, side walls 84 and 85, and front 86 and rear 87 walls. While in the preferred form the housing is shown formed of sheet plastic material, it will be noted that the housing could be made of other suitable waterproof material such as foil or metal.

Enclosed within the housing 80 are a plurality of layered sets of parallel cross-current or counter-flow air passages extending longitudinally from front to rear. The counter-flow passages in the disclosed form of the invention are formed of porous paper-board cellulose material comprising alternating vertically oriented flat separator sheets 92 and intermediate passage forming spacer members preferably in the form of corrugated sheets 94 and 95 which hold the flat separator sheets 92 in uniform spaced relationship defining layered sets of parallel air passages. While the corrugated spacer sheets 94 are shown having an undulating cross section it will be appreciated that other sections, such as U-shaped or triangular corrugations, for example, could be used without departing from applicant's invention.

In the embodiment shown there are four layered sets of alternate air passages **96*a*–96*d* and four layered sets of air alternate passages 97*a*–97*d* with the separator sheets 92 and the corrugated spacer sheets 94 defining the passages 96*a*–96*d* while the separator sheet 92 and the corrugated spacer sheets 95 define the passages 97*a*–97*d*. It will be noted in FIG. 5 that the corrugated spacer sheets 95 are of a predetermined reduced length, compared to sheets 92 and 94, such that their front and rear edges are spaced inwardly from the plane of the front and rear edges respectively, of the corrugated spacer sheets 94 and the sheets 92. Vertically extending capping strips 99 of suitable impervious material are located at the front edges of adjacent sheet 92 to seal off the space created by the termination of the corrugated spacer sheets 95 said predetermined distance from the front edge of the separator sheets 92. In this manner four central front vertical air flow manifold channels, only one of which is shown at 93 in FIG. 5 are defined. Each of the front vertical channels have their lower air entrance ends located to receive an upward flow of above-freezing moist air from central duct 114 to be described. While the separator sheets 92 and the corrugated spacer sheets 94 and 95 may be formed of various suitable hydrophilic fibers or porous material, in the present embodiment the sheets 92, 94 and 95** are made from relatively inexpensive cellulose paper material such as kraft corrugated packing board.

As viewed in FIGS. 3–5, the four layered sets of passages **96*a*–96*d* have their rear inlet ends communicating with the central rear header duct portion 69, defined by bottom frame member 100, top frame member 102 and side vertical frame members 103 and 104. The side members 103, 104 have side sealing flanges 105 and 106 while the top and bottom frame members have identical end sealing flanges, as seen by top frame flange 107 in FIG. 5. The central header duct portion 69 inlet is thus positioned in sealed relation around the cabinet rear wall outlet 66 (FIG. 2) to receive the flow of chilled or below-freezing relatively dry air exiting cabinet duct 64, indicated by long solid arrows 101**.

The passages **96*a*–96*d*, receiving the chilled dry air, have their opposite outlet or front open ends terminating in a second front header or plenum 110 which is coextensive with the front wall 86 of the housing 80. The front header 110 receives the remoisturized air exiting the layered sets of passages 96*a*–96*d* and causes the air to divide and exit the header 110 through side longitudinal flow passages, in the form of alternating layered sets of parallel right 108*a*, 108*b* and left 108*c*, 108*d* side parallel air passages as viewed in FIG. 5. It will be seen in FIGS. 2 and 5 that the front header plenum 110 is not in communication with the exit 112 of the central vertical housing duct 114, the open end of which receives relatively moist above-freezing air (indicated by dashed arrows 115) flowing upwardly from the fresh food compartment 24. By virtue of applicant's unique arrangement the rectangular sectioned duct 114 has its front wall 116 offset rearwardly from the housing front wall 86 and is of a lateral extent such that duct 114 is in communication only with the lower open ends of the four front vertical flow channels 93 in communication with the passages 97*a*–97*d*. It will be noted that the compartment 24 humid return air, shown by dashed arrows 115, is prevented from entering the four central passages 96***a*–96*d* from the underside thereof by longitudinal lower impervious sealing strips, shown at 117 in FIG. 5. The vertical manifold channels 93 receives the vertical flow of the moist above-freezing cabinet return air and distribute it for rearward longitudinal flow through the second set of counter-flow layered air passages 97*a*–97*d*.

In a similar manner, as described above, FIG. 4 shows the corrugated spacer sheets 95 have their rear end edges 121 terminating a predetermined spaced distance from the plane of the rearward ends of separator sheets 92 and corrugated spacer sheets 94. Rear sealing or capping strips 122 are interposed between adjacent separator sheets 92 in said plane to define four rear central vertical flow manifold channels 124*a*–124*d*, the upper open ends of which communicate with rear header duct portion 126 defined by front 127, back 128 and top 130 walls so as to extend transversely the full width of the housing. In the disclosed embodiment the rear header or reversing duct portion 126 is shown formed integrally with the housing top wall 82 and, as seen in FIG. 2, with its back wall 128 being offset forwardly from the housing rear wall 87 such that it is in communication with the upper open ends of the rear vertical flow channels 124*a*–124*d*.

Thus, it will be appreciated that the circulation of the relatively dry below-freezing air of solid arrows 101 in the first alternate layered sets of passages 96*a*–96*d* and the circulation of the relatively moist or humid above-freezing air of dashed arrows 115 in the alternate second layered sets of passages 97*a*–97*d* are in opposite directions. The result is an exchange of moisture occurs between the air streams 101 and 115 by virtue of the moisture being absorbed and adsorbed within the passages 96*a*–96*d* so as to be transpired and diffused through the cellulose paper material of the flat separator sheets 92. Due to the moisture vapor pressure difference between passages 96*a*–96*d* and 97*a*–97*d*, the opposite or counter current flowing air streams 101 and 115 causing the simultaneous dehumidifying of the air stream in passages 97*a*–97*b* and rehumidifying the air stream in passages 96*a*–96*d*.

As best seen in FIG. 4, the defroster-humidifier provides four layered sets of parallel passages on each side of and identical to the central layered sets of passages. Thus, alternating layered sets of parallel right 134*a*, 134*b* and left 134*c*, 134*d* side air passages. Vertical flow manifold channels for each of the side passages 134*a*–134*d* are shown at 137*a*–137*d* respectively, to provide communication with the reversing header duct 126.

As seen in FIGS. 4 and 5, 5, the relatively warm dehumidified air exits the second layered sets of alternate passages 97*a*–97*d* and flows upwardly in their associated four rear vertical channels 124*a*–124*d* into reversing header portion 128 and divides or branches for tranverse flow to left 137*a*, 137*b* and right 137*c*, 138*d* vertical flow channels, indicated by short arrows 132, for forward flow in the left 134*a*, 134*b* and right 134*c*, 134*d* side layered sets of passages. It will be noted in FIG. 5 that the side passages 108*a* – *108d* are formed with corrugated spacer sheets 144 extending the full length of the separator sheets 92 while the side corrugated spacer sheets 145 have a predetermined reduced length in an identical manner to the central corrugated spacer sheets 94, 95 to provide the rear vertical channels 137*a*, 137*b* and 137*c*, 137*d*, and front vertical channels indicated at 139*c* and 139*d* for the right side of the unit. The channels 139*c* and 139*d* are closed at the forward end by sealing strips 140*c* and 140*d*, respectively.

Thus, the dehumidified chilled air exits the side passages 134*a*–134*d* and flows upwardly in the front vertical channels, indicated on the right in FIG. 5 at 139*c*, 139*d*, or on the left by their associated sealing strips 140*a*, 140*b*. The left side front vertical channels communicate with vertical duct 143 while the right side front vertical channels 139*c* and 139*d* communicate with duct 142. In this manner dehumidified air, indicated by short arrows 132, exits ducts 142 and 143 for vertical flow into their associated partition ducts 52 and enters the evaporator chamber 48. The result is that dehumidified air is drawn past the evaporator and chilled to a suitable below-freezing temperature for distribution to the cabinet ducts 62 and 64. It will be appreciated that by virtue of the substantial decrease in the humidity of the air supplied to the evaporator will alleviate the frost build-up on the fins and thus lengthen the time between defrost cycles with a consequent saving of energy.

With reference to FIGS. 4 and 5, it will be seen that the below-freezing air exits the layered sets of central passages 97*a*–97*d* and branches for transverse flow front header portion 110 for distribution into left side 108*a*, 108*b* and right side 108*c*, 108*d* layered sets of passages as indicated by the dash-dot arrows 152. The side passages 108*a*–108*d* direct the chilled or below-freezing humidified air rearwardly for exit into rear side header portions 160 and 162. The left side header portion 160 has a side exit 164 and the right side header portion 162 has a side exit 166 for outward distribution into the above-freezing or fresh food storage compartment 24. It will be obvious that the chilled humidified air could be supplied to separate food storage compartments or storage drawers, if desired, as an alternative to supplying the whole compartment 24.

It will be appreciated that applicant's novel arrangement of passages provides for a secondary exchange of moisture through the walls of the side flow passages. This results from the above-freezing air returning to the forward ducts 142 and 143 through alternate side layered sets of passages 134*a*–134*d* while below-freezing air is flowing rearwardly to the rear header portions 160, 162 through alternate side layered sets of passages 108*a*–*108d*. The fact, however, that the moisture level of the air in passages 108*a*–*108d* has already been substantially reduced in the central counter-flow passages and the air in passages 134*a*–134*d* has already been substantially rehumidified diminishes the vapor pressure difference needed to drive the moisture from the side passages 134*a*–134*d* into the side passages 108*a*–108*d*.

It will be noted that top and bottom capping strips, similar to the rear and front capping strips 122 and 99, are provided as indicated at 167 and 168 in FIG. 4 to seal off the upper and lower ends of their associated layered sets of passages. Thus, eight capping strips 167 are provided having a predetermined length equal to their associated corrugated spacer sheets, i.e. side corrugated spacer sheets 144, 145 and central corrugated spacer sheets 95. Further, the eight capping strips 168 are provided having a predetermined length equal to their associated central corrugated spacer sheets 94. In the disclosed embodiment the capping strips are formed from waterproof, foil coated material.

It will be appreciated that while the preferred embodiment discloses a cellulose or hydrophilic fibrous paper-like material such as kraft corrugated packing board for the inexpensive construction of applicant's device other materials are contemplated. Thus, the countercurrent moisture exchange effect can be obtained from other hydrophilic materials such as wood veneer, polyvinyl alcohol films, or cellulose acetate as well as from other paper material containing desiccant powder such as $S_1O_2$, alumina or charcoal. Further, other non-hydrophilic porous material is also contemplated such as sintered ceramic or fibrous materials such as glass fibre paper or plastic fibre paper will also provide capillarity and diffusion transfer of adsorbed-condensed moisture through the porous membrane-like structure to the returning cooled dry air stream.

Mention should also be made that while the disclosed form shows one countercurrent air flow arrangement, other counter-current arrangements could be used without departing from the scope of the invention. Thus, applicant's defroster-humidifier 70 could be rotated 180° such that the above-freezing moist air from the food compartment 24 could be drawn into the two ducts 142 and 143 for passage through the side layered sets of passages 134*a*–134*b* and returned through the central layered sets of passages 97*a*–97*d* via transfer header 126 for upward exit to the evaporator chamber 46 through central duct 114.

While the embodiment of the present invention as herein disclosed constitutes a preferred form, it is to be understood that other forms might be adopted.

I claim:

1. A refrigerator comprising, a thermally insulated cabinet having partition means separating said cabinet into an above-freezing food compartment and a below-freezing compartment, evaporator means within said below-freezing food compartment, fan means for circulating air through an air flow system in said refrigerator, said air flow system including an air humidifier-defroster apparatus in said above-freezing food compartment enclosed by housing means, said housing means including a plurality of layered sets of parallel air flow passages formed by corrugated hydrophilic material comprising alternating flat sheets and intermediate corrugated sheets holding the flat sheets in spaced relationship, first header means at one end of said housing means and second header means at the opposite end of said housing means, means for supplying chilled relatively dry air to said first header means, first alternate layered sets of said parallel air passages each having inlet ends connected to said firt header means and outlet ends connected to said second header means, second intermediate layered sets of parallel air passages having inlet ends adjacent said outlet ends of the first sets of air passages and having outlet ends adjacent said inlet ends of the first sets of air passages, means for supplying relatively moist above-freezing air from said above-freezing compartment to the inlet ends of said second intermediate sets of parallel air flow passages, whereby said air flow system causes the circulation of the relatively dry chilled air stream in said alternate sets of passages and the circulation of the relatively moist above-freezing air stream in the intermediate sets of passages to be in opposite directions such that an exchange of moisture between the streams occurs by both diffusion and capillary flow of moisture through the fibrous material from the second intermediate sets of air passages to the first alternate sets of air passages as a result of the moisture vapor pressure difference of the opposite flowing air streams therein, duct means communicating with said second header means, whereby above-freezing relatively dry air is circulated over said evaporator means for chilling thereof, and whereby the chilled relatively moist air exiting from the outlet ends of the first alternate sets of air passages is circulated by duct means of said air flow system to said above-freezing food compartment.

2. A refrigerator comprising, a thermally insulated cabinet having partition means separating said cabinet into an above-freezing food compartment and a below-freezing compartment, evaporator means located in an evaporator chamber within said below-freezing food compartment, fan means for circulating air through an air flow system in said refrigerator, said air flow system including an air humidifier-defroster apparatus in said above-freezing food compartment enclosed by housing means, said housing means including a plurality of layered sets of parallel air flow passages formed by corrugated hydrphilic fibrous paper-like material comprising alternating flat sheets and intermediate undulating sheets holding the flat sheets in spaced relationship, first header means at one end of said housing means and second header means at the opposite ends of said housing means, said first header means connected by said flow system for receiving chilled relatively dry air from said evaporator chamber, first alternate layered sets of said parallel air passages each having inlet ends connected to said first header means and outlet ends connected to said second header means, second intermediate layered sets of parallel air passages having inlet ends adjacent said outlet ends of the first sets of air passages and having outlet ends adjacent said inlet ends of the first sets of air passages, duct means in said air flow system for receiving relatively moist above-freezing air from said above-freezing compartment for flow to the inlet ends of said second intermediate sets of parallel air flow passages, whereby said air flow system causes the circulation of the relatively dry chilled air stream in said alternate sets of passages and the circulation of the relatively moist above-freezing air stream in the intermediate sets of passages to be in opposite directions such that an exchange of moisture between the air streams occurs by both diffusion and capillary flow of moisture through the paper-like material from the econd intermediate sets of air passages to the first alternate sets of air passages as a result of the moisture vapor pressure difference of the opposite flowing air streams therein, the outlet ends of said second intermediate sets of parallel air flow passages connected by duct means to said evaporator chamber, whereby above-freezing relatively dry air is circulated over said evaporator means for chilling thereof, and whereby the chilled relatively moist air exiting from the outlet ends of the first alternate sets of air passages is circulated by duct means of said air flow system to said above-freezing food compartment.

3. A refrigerator comprising, a thermally insulated cabinent having partition means separating said cabinet into an above-freezing food compartment and a below-freezing cmpartment, evaporator means located in an evaporator chamber within said below-freezing food compartment, fan means for circulating air through an air flow system in said refrigerator, said air flow system including an air humidifier-defroster apparatus in said above-freezing food compartment enclosed by housing means, said housing means including a plurality of central and side layered sets of parallel air flow passages formed by corrugated hydrophilic fibrous paper-like material comprising alternating flat separator sheets and intermediate undulating spacer sheets holding the flat sheets in spaced relationship, first header means at one end of said housing means and second header means at the opposite end of said housing means, said first header means connected by the said flow system for receiving chilled relatively dry air from said evaporator chamber, first central alternate sets of said parallel air passages each having inlet ends connected to said first header means and outlet ends connected to said second header means, second central intermediate sets of parallel air passages having inlet ends adjacent said outlet ends of the first sets of air passages and having outlet ends adjacent said inlet ends of the first sets of air passages, duct means in said air flow system for receiving relatively moist above-freezing air from said above-freezing compartment for flow to the inlet ends of said second intermediate sets of parallel air flow passages, whereby said air flow system causes the circulation of the relatively dry chilled air stream in said alternate sets of passages and the circulation of the relatively moist above-freezing air stream in the intermediate sets of passages to be in opposite directions such that an exchange of moisture between the air streams occurs by both diffusion and capillary flow of moisture through the paper-like material from the second intermediate sets of air passages to the first alternate sets of air passages as a result of the moisture vapor pressure difference of the opposite flowing air streams therein, each undulating sheet forming the second alternate sets of parallel air passages having a longitudinal dimension a pedetermined distance less than the alternating flat sheets whereby a vertical channel is provided at the exit end of each undulating sheet forming the second alternate sets of parallel air passages, the upper outlet ends of the vertical channels connected by transverse duct means to said layered sets of parallel side passage means located on either side of the first and second layered sets of parallel central air flow passages, said side passage means communicating via vertical duct means to said evaporator chamber, whereby above-freezing relatively dry air is circulated over said evaporator means for chilling thereof, and thereby the chilled relatively moist air exiting from the outlet ends of the first alternate sets of air passages is circulated by duct means of said air flow system to said above-freezing food compartment.

* * * * *

UNITED STATES PATENT AND TRADEMARK OFFICE

CERTIFICATE OF CORRECTION

PATENT NO. : 4,075,866

DATED : February 28, 1978

INVENTOR(S) : Victor A. Williamitis

It is certified that error appears in the above-identified patent and that said Letters Patent are hereby corrected as shown below:

Col. 3, line 34, "ince" should be -- ice --;
same line, after "water" delete "ice" and insert -- to --;
line 36, "3,599,422" should be -- 3,599,442 --.

Col. 4, line 9, "sheets" should be -- sheet --;
line 18, "sheet" should be -- sheets --.

Col. 5, line 4, "receives" should be -- receive --;
line 53, "Figs. 4 and 5, 5," should be -- Figs. 4 and 5 --.

Col. 7, line 41, after "hydrophilic" insert -- fibrous --;
line 49, "firt" should be -- first --;
line 63, after "the" insert -- air --.

Col. 8, line 19, "hydrphilic" should be -- hydrophilic --;
line 24, "ends" should be -- end --;
line 44, "econd" should be -- second --;
line 57 "cabinent" (first occurrence) should be -- cabinet --;
line 59, "cmpartment" should be -- compartment --.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*